US010961649B2

(12) United States Patent
Coric

(10) Patent No.: US 10,961,649 B2
(45) Date of Patent: Mar. 30, 2021

(54) BUCKET WASHING ATTACHMENT

(71) Applicant: TRANSFORM SR BRANDS LLC, Hoffman Estates, IL (US)

(72) Inventor: Milos Coric, Lincolnshire, IL (US)

(73) Assignee: TRANSFORM SR BRANDS LLC, Hoffman Estates, IL (US)

( * ) Notice: Subject to any disclaimer, the term of this patent is extended or adjusted under 35 U.S.C. 154(b) by 500 days.

(21) Appl. No.: 14/559,692

(22) Filed: Dec. 3, 2014

(65) Prior Publication Data

US 2016/0158816 A1 Jun. 9, 2016

(51) Int. Cl.
*D06F 5/04* (2006.01)

(52) U.S. Cl.
CPC ..... *D06F 5/04* (2013.01)

(58) Field of Classification Search
None
See application file for complete search history.

(56) References Cited

U.S. PATENT DOCUMENTS 4,472,063 A * 9/1984 Eickelmann ..... B01F 7/00391 366/129
4,506,989 A * 3/1985 Reh ..... B01F 15/00012 366/270
8,887,539 B1 * 11/2014 Hernandez ..... D06F 5/04 68/57
9,109,316 B1 * 8/2015 Thomson ..... D06F 5/00
2007/0086271 A1 * 4/2007 Hamilton ..... B01F 7/0005 366/325.2
2014/0133267 A1 * 5/2014 Rupp ..... B01F 7/00116 366/282

FOREIGN PATENT DOCUMENTS

WO WO-02057529 A2 * 7/2002 ..... D06F 1/12

* cited by examiner

*Primary Examiner* — Cristi J Tate-Sims
(74) *Attorney, Agent, or Firm* — McAndrews, Held & Malloy, Ltd.

(57) ABSTRACT

Apparatuses and methods based thereon are provided for utilizing washing attachments in portable manner. A washing attachment may comprise a movement component and a washing component. The movement component is adapted to connect the washing attachment to a driving device that is operable to provide a driving force to the washing attachment. The washing component is adapted to fit within a space in the container when the washing attachment is applied to the container, and is configured to facilitate laundry washing within the space when the driving force is applied to the washing attachment. The washing component may be an auger component having a helical-shaped structure. The helical-shaped structure may comprise helical extensions (e.g., spiral blades) configured to generate washing movement in the space. When the driving device is a power drill, the helical-shaped structure may be designed such that the spacing between spiral blades of the structure is 0.9 inches.

37 Claims, 3 Drawing Sheets

BUCKET WASHING ATTACHMENT

TECHNICAL FIELD

Aspects of the present application relate to containers, particularly commonly available buckets that are typically sold and/or used by individual consumers (e.g., for home improvement projects). More specifically, certain implementations of the present disclosure relate to bucket washing attachments, which may be used to facilitate laundry and clothes washing in portable and convenient manner, such as using commonly available buckets (e.g., 5-gallon buckets).

BACKGROUND

Existing methods and apparatuses, if any exist, for facilitating portable laundry and clothes washing may be costly, cumbersome and inefficient. Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY

System(s) and/or method(s) are provided for mixing material by use of container (e.g., bucket) washing auger attachments, substantially as shown in and/or described in connection with at least one of the figures, as set forth more completely in the claims.

These and other advantages, aspects and novel features of the present disclosure, as well as details of illustrated implementation(s) thereof, will be more fully understood from the following description and drawings.

DETAILED DESCRIPTION

As utilized herein, the term "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y and z." As utilized herein, the terms "block" and "module" refer to functions than can be performed by one or more circuits. As utilized herein, the term "example" means serving as a non-limiting example, instance, or illustration. As utilized herein, the terms "for example" and "e.g.," introduce a list of one or more non-limiting examples, instances, or illustrations.

Figure 1:
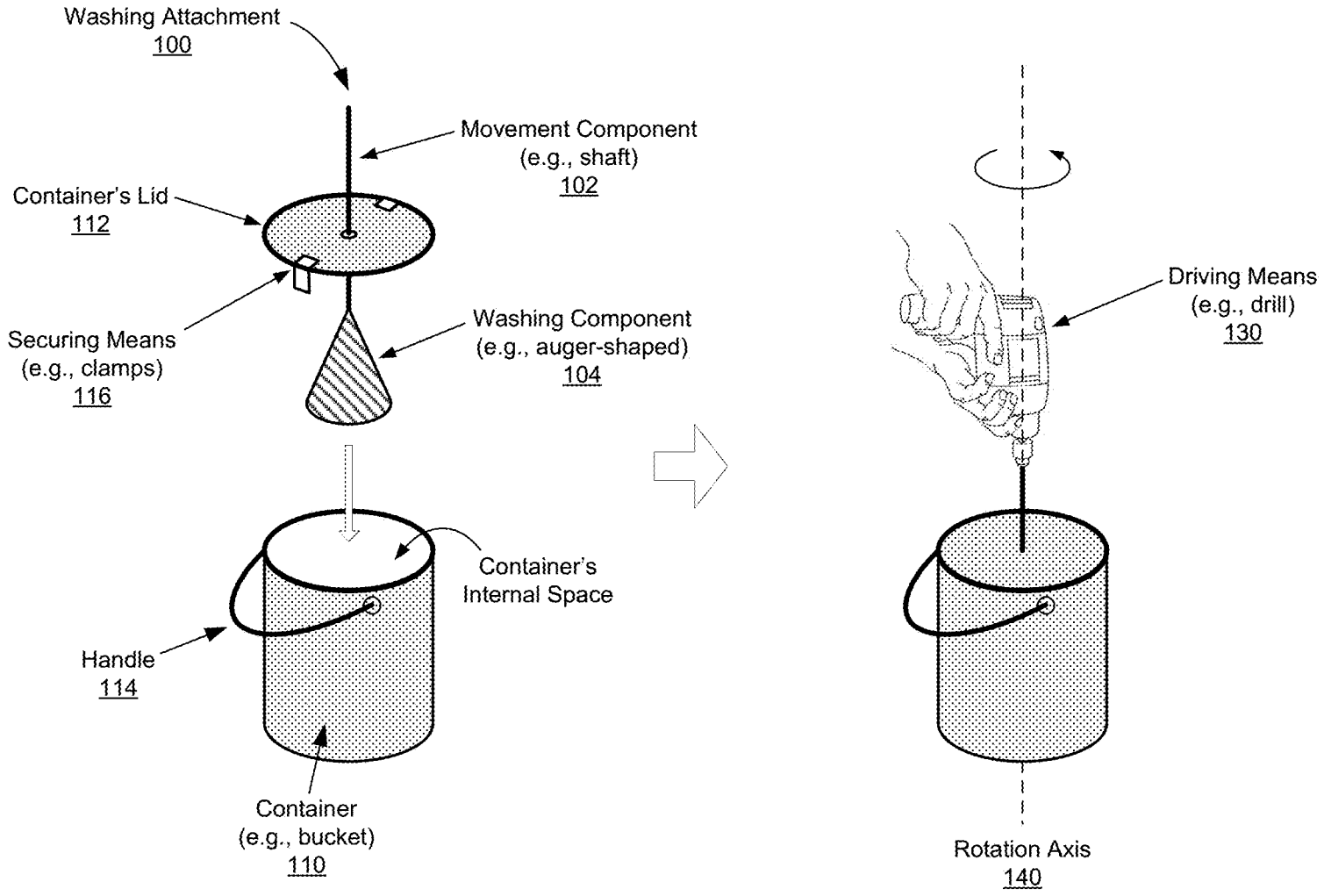
FIG. 1 illustrates an example use of a washing auger attachment, in accordance with an embodiment of the present invention.

FIG. 1 illustrates an example use of a washing attachment, in accordance with an embodiment of the present invention.

Shown in FIG. 1 is a washing attachment 100, which may be implemented in accordance with an example embodiment of the present disclosure.

The washing attachment 100 may be designed and/or manufactured such that it may apply to and used in suitable container, particularly those readily available for home improvement projects for example, to facilitate portable washing operations. In particular, the washing attachment 100 may facilitate laundry and clothes washing in a convenient and cost-effective manner when dedicated laundry appliances (or services) may not be available or when use of such appliances (or services) may not feasible. For example, washing attachments implemented in accordance with the present disclosure (e.g., the washing attachment 100) may enable utilization of readily available buckets (e.g., 5-gallon bucket or similar size containers commonly sold) in a laundry washing type application, particularly in situations where laundry washing may be desired or needed, but traditional means for doing so (use of dedicated appliances or access to dedicated services) may be not be possible. Example use scenarios for these washing attachments may comprise laundry washing during outdoor activities (e.g., camping, tailgating, etc.); in laundry washing during emergency situations; laundry washing in absence of electric power (e.g., power outages); degreasing used rags in automotive services to be reused again, etc. To further enhance utility and portability, washing attachments in accordance with the present disclosure (e.g., the washing attachment 100) may particularly be designed or implemented for use in conjunction with tools that have portable power supply—e.g., drills with (re-chargeable) batteries. Accordingly, use of washing attachments in accordance with the present disclosure (e.g., the washing attachment 100) may allow a simple and inexpensive way for performing washing by providing laundry (textile) agitation when to-be washed items are immersed in liquid emulsion (water, detergent, any other solvent) contained in a sealed readily available container (e.g., typical consumer buckets).

In the example implementation shown in FIG. 1, the washing attachment 100 may comprise a movement component (e.g., shaft-shaped) 102 and a washing component (e.g., auger-shaped) 104. The movement component 102 may be configured for use in conjunction with suitable means for driving the washing attachment 100. For example, the movement component 102 may be configured to insert into suitable driving means (e.g., a power drill) 130. The drill 130 may preferably be configured to enable portable use—e.g., supporting use of rechargeable batteries, such that it may be used when there may not be access to power outlets. The washing component 104 may be configured for providing the laundry washing function in the particular intended manner—e.g., for facilitating laundry washing that is done within commonly available containers (e.g., buckets). Washing components (e.g., the washing component 104) may be designed and/or configured in various ways, particularly to provide optimal laundry washing within enclosed space of anticipated used container. A particular, auger-based implementation is described in more detail below (e.g., FIG. 2).

The containers that may be used in conjunction with washing attachment implemented in accordance with the present disclosure (e.g., the washing attachment 100) need not be limited to any particular design, shape, and/or make. Such containers would minimally need to have, however, a space with an opening to which the washing attachment 100 may be applied, to facilitating enclosing the space such that the space may be used when mixing material. For example, the container 110 shown in FIG. 1 may be a bucket (e.g., a 5-gallon bucket) which may be abundantly available.

The characteristics of the containers which may make them suitable for use in conjunction with washing attachments implemented in accordance with the present disclosure (e.g., the washing attachment 100 shown in FIG. 1) may be based on and/or relate to the characteristics of the washing attachments. In other words, to-be used containers may be selected only when deemed suitable for operation in conjunction with the washing attachment—e.g., having suitable (size and/or shape wise) internal space, having lid to seal the inside of the container (with a hole through which the shaft may be run), etc. Alternatively, the design of the washing attachments may be based on anticipated characteristics of the containers to be used in conjunction with the washing attachments. For example, with reference to the example washing attachment 100 shown in FIG. 1, the movement component 102 may be particularly configured or designed such that it may be run through the container's lid 112. Similarly the washing component 104 may be designed with particular size and/or shape to fit into (and operate within) containers having certain internal spaces (e.g., depth of internal space is greater than the length of the washing component 104, and/or with openings that are wide enough to fit the washing component 104). As described in more detail below, the shape and related characteristics of the washing component 104 may be particularly designed to create pre-determined washing movement that is optimal based on the driving force (e.g., the rotation speed/power of the driving drill 130) and the internal space of the anticipated containers.

In some implementations, containers used in conjunction with the washing attachments may incorporate handling means (e.g., a handle), which while originally intended for use when utilizing the container for their intended uses, may also be used in support of the laundry washing functions performed using the washing attachments—e.g., to enable and/or provide ease of handling of combinations of the containers and the washing attachments. For example, with reference to the embodiment shown in FIG. 1, the container 110 may comprise handling means (e.g., handle) 114 that may be used to enable and/or provide ease of handling of the combination of the container 110 and the washing attachment 100. The handling means (handle) 114 may be used, for example, to enable a user (e.g., consumer attempting to use the container/washing attachment to mix some material) to hold the container/washing attachment combination steady and/or move it when effectuating the laundry washing.

In some implementations, securing means (e.g., clamps, clips, or the like) may be used to facilitate and/or enhance sealing of containers used in laundry washing (in conjunction with the washing attachment). For example, with reference to the embodiment shown in FIG. 1, securing means 116 (e.g., clamps or clips) may be used to secure the container's lid 112 to the container 100, such that the articles being washed (and the water/washing material) would remain within the internal space of the container 110. While the securing means (as shown in the example implementation depicted in FIG. 1) may be part of the container (or part thereof) itself, in other implementations securing means may be part of the washing attachment, or may be a separate component which may be applied to the washing attachment (s) and/or the corresponding container(s) when needed.

In some implementations, some of the elements of the washing attachment 100 as described herein may be available as separate components. For example, the washing component 104 may be available as a separate component, thus allowing for offering of different washing components (e.g., of various size and/or shapes) that may be attached to the movement component 102 when needed, to be selected based on the selected (or available) container, or characteristics thereof, to provide the overall "washing attachment." This may be desirable to enable using the same attachment shaft with varying sized and/or shaped components (e.g., washing augers of various sizes and/or with adjusted sizing characteristics).

The washing attachment 100 may be applied to cheap, readily available containers (e.g., standard 5-gallon bucket), such as when these container and the mixing insert 100 have matching characteristics (e.g., the shape and/or size of the container's opening and the insert's enclosing section match; the washing attachment 100 may be secured to the container using the securing means 116; the container is suitable for intended use, etc.).

Accordingly, use of the washing attachment 100 may enable converting such cheap, readily available containers into a simple and portable laundry washing solution (e.g., for washing laundry in situations where access to typical laundry appliances and/or services may not be possible or desirable). This may be a particularly desirable option for outdoor scenarios, thus allowing for performing laundry washing even when there may be no access to power outlets.

In an example use scenario, the articles to be washed may be placed into the internal space of container 110, water and cleaning material (e.g., washing detergent) may be poured into the space, and the washing attachment 100 may then be applied to the container. This may comprise coupling the movement component 104 to the movement component 102, if these components are offered as separate components. Further, the washing attachment 100 may be secured to the container 110, and the internal space may be secured. For example, the movement component (shaft) 102 may be passed through the container's lid 114 (and further secured, if possible, as described in more details with respect to FIG. 3), and the sealing by the container's lid 114 (enclosing the internal space of the container 110) may be secured (e.g., via the securing means 116). The laundry washing may then be performed, by applying a suitable driving force to the washing attachment 100. For example, the washing attachment 100 may be coupled to the driving device 130, which may provide rotational movement as a driving force for the washing attachment 100. The washing component 104 may be generated, in response to the application of the driving force, washing action within the internal space of the container 110. The particular manner by which the washing action is generated may be based on the washing component 104 (e.g., shape and/or size thereof) and/or the driving force. An example of particular washing action and the manner by which is generated in response to the driving force is described with respect to the example, auger-based implementation described in FIG. 2.

Figure 2:
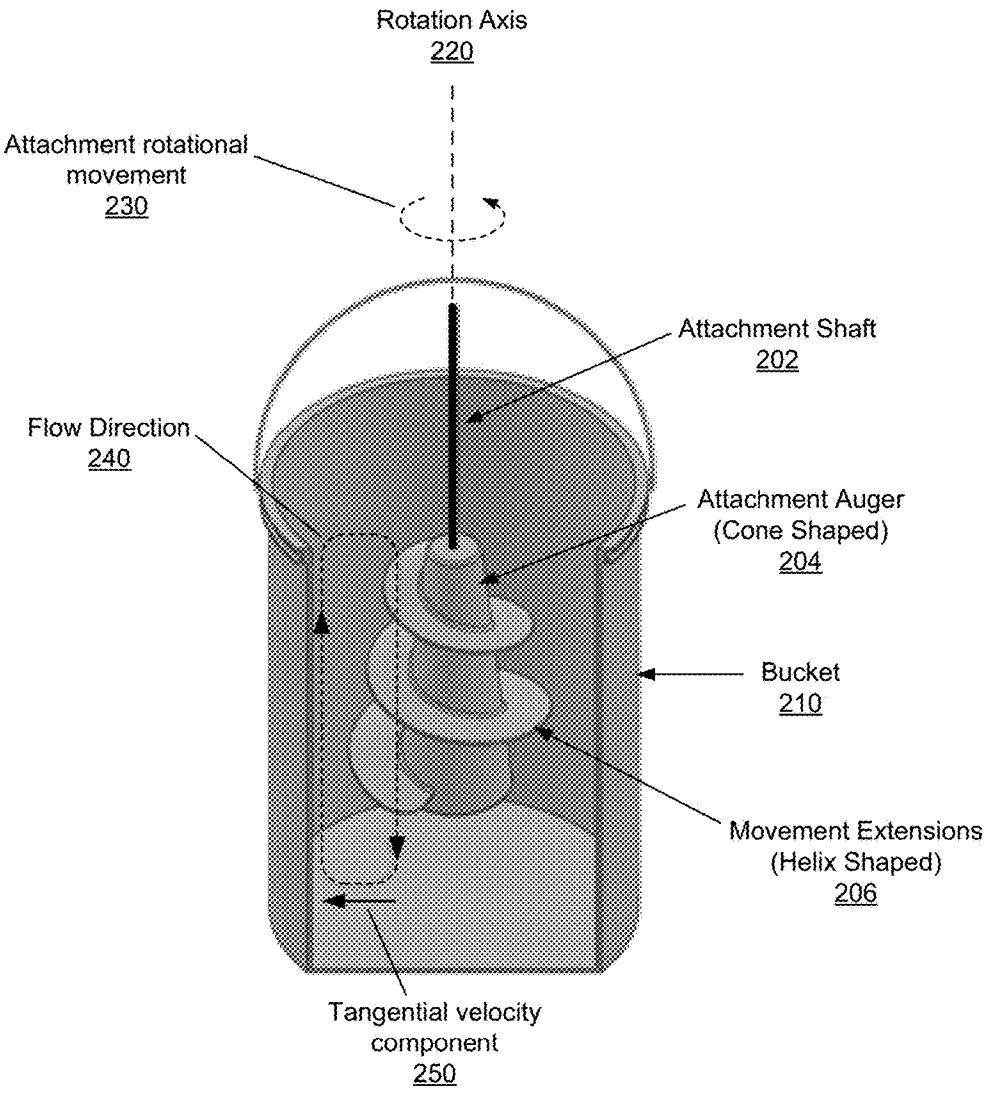
FIG. 2 illustrates an example use of an alternative design of a washing auger attachment, in accordance with an embodiment of the present invention.

FIG. 2 illustrates an example use of an alternative design of a washing auger attachment, in accordance with an embodiment of the present invention. Shown in FIG. 2 is a washing attachment 200, which may be designed and/or manufactured for application to particular containers, to facilitate use of the containers in laundry washing (particularly in a portable manner).

The washing attachment 200 may be substantially similar to the washing attachment 100 of FIG. 1. The washing attachment 200 may comprise an attachment auger 204, and an attachment shaft 202. The attachment shaft 202 may be connected to the attachment auger 204 on one side, may be connected to a driving means (not shown), such as a power drill (preferably with portable power supply source, such as rechargeable batteries), on the other side, and may be run through a cover or lid (not shown) of a container (e.g., bucket) 210.

The attachment auger 204 may comprise a particular structure (e.g., shape and/or dimensions) which may be particularly designed and/or configured to facilitate laundry washing in accordance with particular anticipated use scenarios, and to specifically do so in optimal manner. For example, the attachment auger 204 may be designed and/or configured in anticipation of application of the washing attachment 200 to certain types of containers (e.g., 5-gallon buckets) having internal space in which the laundry washing is performed, and with the washing attachment 200 being driven by particular anticipated driving means (e.g., power drills). Further, the structure of the attachment auger 204 may be particularly designed to achieve optimal washing conditions (e.g., generating optimal washing movements) under anticipated use conditions for yielding optimal washing results.

In the example implementation shown in FIG. 2, the attachment auger 204 may have conical-shaped body with movement extensions (e.g., spiral blades) 206 which would generate washing movements in the space based on movement of the attachment shaft/auger combination. The movement extensions 206 may have, for example, a helical structure protruding from the conical-shape body, which (the helical structure) may act to provide washing movement within the space when the washing attachment 200 is rotated. Thus, in an example use scenario, the washing attachment 200 may be applied to a container/bucket 210, to provide laundry washing therein (within the bucket's internal space), and the driving means (e.g., a power drill) may be attached to the attachment shaft 202, to provide a driving force. The driving force applied to the attachment shaft 202 may result in a rotational movement 230 (e.g., in a clockwise direction) around a rotation axis 220 (running along the attachment shaft 202), thus rotating the attachment shaft 202 and the attachment auger 204.

The rotation of the attachment shaft 202 and the attachment auger 204 then generates the necessary washing movement within the internal space of the bucket 210. In particular, the helical structure 206 protruding from the conical-shaped body of the attachment auger 204 may act as a propellant (e.g., screw or thread type of action) when the washing attachment 200 is rotated, which may create rotational movement within the internal space of the container/bucket 210. When the attachment 200 is subject to rotational movement 230, the action of the helical structure 206 may cause a mixture of water, detergent and laundry articles (items to be washed) to circulate in the flow direction 240 indicated in FIG. 2

As noted above, the design of the attachment auger 204 may be specifically configured based on the anticipate use conditions. Thus, the design of the helical structure 206 of the attachment auger 204 may be based on the anticipated use conditions—e.g., the anticipated driving means (power drills) and container to which the attachment is applied (e.g., 5-gallon buckets), and to particularly provide optimal washing operations based on the anticipated use conditions. For example, the helical structure 206 of the attachment auger 204 may be designed to achieve the optimal rotational speed within the space—that is the speed where the power of detergent and mechanical rubbing would yield optimal washing results.

In an example implementation, the spacing between spiral blades (pitch) of the helical structure 206 may be approximately 0.9 inches, which may be optimal for use with drills having speed revolutions of approximately 400 RPM (rotation per minute). Such configuration may result in an axial speed of agitation of 30 feet/min, which may correspond to optimal rotational speed.

Due to the conical shape of the body of the auger attachment 204, the channel formed by the "washer attachment" and the inner wall of the bucket, may narrow down towards the bottom of the buck. Axial velocity of the water/laundry mixture may accelerate because of this, thus resulting in "tangential component". This tangential component, increased velocity and kinetic energy and continued action of the attachment auger may provide enough energy for constant vigorous cyclic motion. In addition, the tangential component of the velocity also reduces the fluid turbulence as it hits the bottom of the bucket. The turbulence is much higher if the fluid hits the bottom at 90° angle. This quick motion is conducive to the mechanical "rubbing" of the garments against each other and cleaning action of the detergent.

Figure 3:
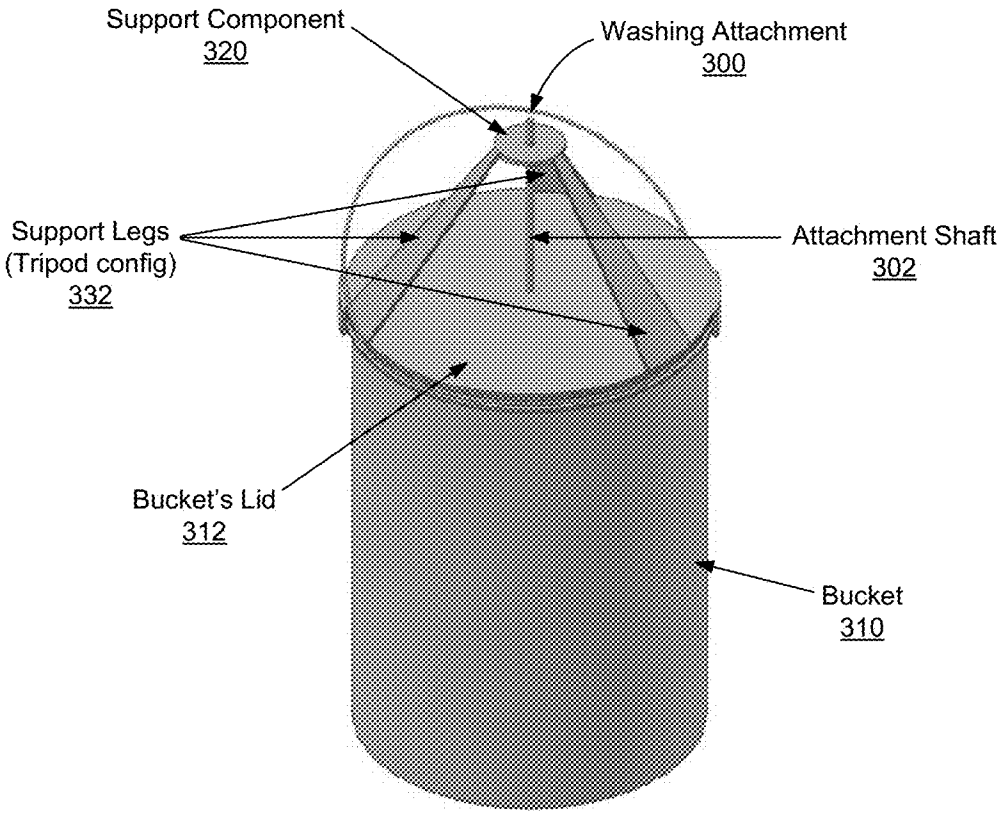
FIG. 3 illustrates an example support structure for washing auger attachments, in accordance with an embodiment of the present invention.

FIG. 3 illustrates an example support structure for washing auger attachments, in accordance with an embodiment of the present disclosure. Shown in FIG. 3 is a washing attachment 300, which may be designed and/or configured for application to particular containers, such as a bucket 310 (e.g., a 5-gallon bucket), to facilitate use of such containers for portable laundry washing.

The washing attachment 300 may be substantially similar to the washing attachment 100 of FIG. 1, or the washing attachment 200 of FIG. 2. For example, the washing attachment 300 may comprise an attachment shaft 302 connected to an attachment auger (not shown, as it is hidden within the bucket 310). The attachment shaft 302 may be run through suitable hole in the bucket's lid (or cover) 312. The washing attachment 300 may operate in substantially the same manner as described with respect to the washing attachment 100 of FIG. 1 and/or the washing attachment 200 of FIG. 2. In addition, in the example implementation depicted in FIG. 3, a support structure may be used to secure the washing attachment 300 to a container (e.g., the bucket 310) to which the washing attachment 300 is applied. For example, as shown in FIG. 3, an example support structure may be a tripod-like support structure, which may support the attachment washer while it is being connected to and/or is driven by a corresponding driving means (e.g., power drill). The tripod-like support structure may comprise a base support component 320, through which the attachment shaft 302 runs, and a plurality (e.g., three) of support legs. Use of the support structure may, in addition to simply supporting the washing attachment 300, obviate the need for the user to continually hold the driving means during laundry washing. Thus, when the tripod structure shown in FIG. 3 is used, there may not be a need for the user to continually support the power drill (e.g., no need for the user to hold it by hand) while the power drill is being used to drive the washing attachment 300. Another added benefit for use of a support structure is that it may counteract or prevent undesirable actions (e.g., movement) by the driving means. For example, when the tripod structure shown in FIG. 3 is used, it may counter a tendency of the power drill to rotate in the opposite direction of the attachment auger.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. An apparatus, comprising:

a driving device configurable to operate in a portable manner using a portable power source that is coupled to or integrated into the driving device; and a washing attachment that is configured to be applied to a particular container, the washing attachment comprising:

a movement component adapted to connect the washing attachment to the driving device that is operable to provide a driving force to the washing attachment; and a washing component, adapted to fit within a space in the container when the washing attachment is applied to the container, wherein:

the washing component is configured to generate a pre-determined washing movement within the space when the driving force is applied to the washing attachment, wherein the washing movement is pre-determined based on one or both of size and shape of the space in the container; and the washing component is configured to generate the washing movement by converting the driving force; and the washing component is configured based on characteristics of the driving force provided by the driving device, wherein the characteristics of the driving force comprise one or both of a rotation speed and a power of the driving device.

2. The apparatus of claim 1, wherein the washing component comprises an auger component having a helical-shaped structure.

3. The apparatus of claim 2, wherein the helical-shaped structure comprises helical extensions configured to generate the washing movement within the space in the container in response to application of the driving force to the washing attachment.

4. The apparatus of claim 1, comprising a securing component for securing application of the washing attachment to the container.

5. The apparatus of claim 4, wherein the securing component comprises one or more elements for securing an enclosing component to the container.

6. The apparatus of claim 5, wherein the one or more elements comprise clamp or a clip based elements.

7. The apparatus of claim 4, wherein the securing component comprises a securing structure for securing the washing attachment when applied to the container.

8. The apparatus of claim 7, wherein the securing structure comprises a multi-pod based structure, the multi-pod based structure comprising:

a base element through which the movement component is passed; and a plurality of support legs, wherein each support leg is connected to the base element on one end and to the container on the other end.

9. The apparatus of claim 1, comprising an enclosing component adapted for application to an opening in the container, to enclose the space in the container.

10. The apparatus of claim 1, wherein the driving force comprises rotating the washing attachment around a rotation axis along the movement component.

11. An apparatus, comprising:

a driving device configurable to operate in a portable manner using a portable power source that is coupled to or integrated into the driving device;

a washing attachment that is configured to be applied to a particular container, the washing attachment comprising:

a movement component adapted to connect the washing attachment to the driving device that is operable to provide a driving force to the washing attachment; and a washing component, adapted to fit within a space in the container when the washing attachment is applied to the container, wherein:

the washing component is configured to generate a pre-determined washing movement within the space when the driving force is applied to the washing attachment, wherein the washing movement is pre-determined based on one or both of size and shape of the space in the container; and the washing component is configured to generate the washing movement by converting the driving force; and an enclosing component adapted for application to an opening in the container, to enclose the space in the container, wherein:

the container comprises a cylindrical shaped space with a circular opening on one end corresponding to the opening of the container; and the enclosing component comprises a circular shaped section that is adapted for application to the circular opening of the cylindrical shaped space.

12. The apparatus of claim 11, wherein the washing component comprises an auger component having a helical-shaped structure.

13. The apparatus of claim 12, wherein the helical-shaped structure comprises helical extensions configured to generate the washing movement within the space in the container in response to application of the driving force to the washing attachment.

14. The apparatus of claim 11, comprising a securing component for securing application of the washing attachment to the container.

15. The apparatus of claim 14, wherein the securing component comprises one or more elements for securing an enclosing component to the container.

16. The apparatus of claim 15, wherein the one or more elements comprise clamp or a clip based elements.

17. The apparatus of claim 14, wherein the securing component comprises a securing structure for securing the washing attachment when applied to the container.

18. The apparatus of claim 17, wherein the securing structure comprises a multi-pod based structure, the multi-pod based structure comprising:

a base element through which the movement component is passed; and a plurality of support legs, wherein each support leg is connected to the base element on one end and to the container on the other end.

19. The apparatus of claim 11, wherein the driving force comprises rotating the washing attachment around a rotation axis along the movement component.

20. An apparatus, comprising:

a driving device configurable to operate in a portable manner using a portable power source that is coupled to or integrated into the driving device, wherein the driving device comprises a power drill comprising integrated power supply source to enable using the power drill in portable manner; and a washing attachment that is configured to be applied to a particular container, the washing attachment comprising:

a movement component adapted to connect the washing attachment to the driving device that is operable to provide a driving force to the washing attachment; and a washing component, adapted to fit within a space in the container when the washing attachment is applied to the container, wherein:

the washing component is configured to generate a pre-determined washing movement within the space when the driving force is applied to the washing attachment, wherein the washing movement is pre-determined based on one or both of size and shape of the space in the container; and the washing component is configured to generate the washing movement by converting the driving force.

21. The apparatus of claim 20, wherein the washing component comprises an auger component having a helical-shaped structure.

22. The apparatus of claim 21, wherein the helical-shaped structure comprises helical extensions configured to generate the washing movement within the space in the container in response to application of the driving force to the washing attachment.

23. The apparatus of claim 20, comprising a securing component for securing application of the washing attachment to the container.

24. The apparatus of claim 23, wherein the securing component comprises one or more elements for securing an enclosing component to the container.

25. The apparatus of claim 24, wherein the one or more elements comprise clamp or a clip based elements.

26. The apparatus of claim 23, wherein the securing component comprises a securing structure for securing the washing attachment when applied to the container.

27. The apparatus of claim 26, wherein the securing structure comprises a multi-pod based structure, the multi-pod based structure comprising:

a base element through which the movement component is passed; and a plurality of support legs, wherein each support leg is connected to the base element on one end and to the container on the other end.

28. The apparatus of claim 20, comprising an enclosing component adapted for application to an opening in the container, to enclose the space in the container.

29. The apparatus of claim 20, wherein the driving force comprises rotating the washing attachment around a rotation axis along the movement component.

30. An apparatus, comprising:

a driving device configurable to operate in a portable manner using a portable power source that is coupled to or integrated into the driving device; and a washing attachment that is configured to be applied to a particular container, the washing attachment comprising:

a movement component adapted to connect the washing attachment to the driving device that is operable to provide a driving force to the washing attachment; and a washing component, adapted to fit within a space in the container when the washing attachment is applied to the container, wherein:

the washing component is configured to generate a pre-determined washing movement within the space when the driving force is applied to the washing attachment, wherein the washing movement is pre-determined based on one or both of size and shape of the space in the container;

the washing component is configured to generate the washing movement by converting the driving force;

the washing component comprises an auger component having a helical-shaped structure;

the helical-shaped structure comprises helical extensions configured to generate the washing movement within the space in the container in response to application of the driving force to the washing attachment; and the helical-shaped structure is designed particularly based on characteristics of the driving force provided by the driving device.

31. The apparatus of claim 30, comprising a securing component for securing application of the washing attachment to the container.

32. The apparatus of claim 31, wherein the securing component comprises one or more elements for securing an enclosing component to the container.

33. The apparatus of claim 32, wherein the one or more elements comprise clamp or a clip based elements.

34. The apparatus of claim 31, wherein the securing component comprises a securing structure for securing the washing attachment when applied to the container.

35. The apparatus of claim 34, wherein the securing structure comprises a multi-pod based structure, the multi-pod based structure comprising:

a base element through which the movement component is passed; and a plurality of support legs, wherein each support leg is connected to the base element on one end and to the container on the other end.

36. The apparatus of claim 30, comprising an enclosing component adapted for application to an opening in the container, to enclose the space in the container.

37. The apparatus of claim 30, wherein the driving force comprises rotating the washing attachment around a rotation axis along the movement component.

* * * * *